United States Patent [19]

Brush, Sr. et al.

[11] Patent Number: 4,502,748

[45] Date of Patent: Mar. 5, 1985

[54] ANTI-DECOUPLING DEVICE FOR AN ELECTRICAL CONNECTOR

[75] Inventors: Robert W. Brush, Sr., Unadilla; Vincent A. Luca, Jr., Sidney; Eric F. Shepler, Bainbridge, all of N.Y.

[73] Assignee: Allied Corporation, Southfield, Mich.

[21] Appl. No.: 553,914

[22] Filed: Nov. 21, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 89

[56] References Cited

U.S. PATENT DOCUMENTS

| | | | |
|---|---|---|---|
| 2,984,811 | 5/1961 | Hennessey, Jr. et al. | 339/45 |
| 3,594,700 | 7/1971 | Nava et al. | 339/89 |
| 3,801,954 | 4/1974 | Dorrell | 339/90 |
| 3,835,443 | 9/1974 | Arnold et al. | 339/90 R |
| 3,876,275 | 4/1975 | Clark | 339/90 |
| 3,892,458 | 7/1975 | Clark | 339/90 |
| 4,066,315 | 1/1978 | Arneson | 339/89 |
| 4,109,990 | 8/1978 | Waldron et al. | 339/89 |
| 4,248,492 | 2/1981 | Snyder | 339/89 |
| 4,255,008 | 3/1981 | Snyder et al. | 339/89 M |
| 4,322,121 | 3/1982 | Riches et al. | 339/89 |
| 4,464,000 | 8/1984 | Werth et al. | 339/89 M |

*Primary Examiner*—John McQuade

*Attorney, Agent, or Firm*—R. J. Eifler

[57] ABSTRACT

This invention is an anti-decoupling mechanism for an electrical connector assembly of the type having two housings (20, 50) connected together by a coupling ring (30). The invention is characterized by an annular member (10) that has a plurality of slots (11) around the periphery thereof that engages the projection (41) on each spring (40) mounted within a coupling ring (30). The annular member (10) is radially expandable to increase its diameter in response to opposing axial forces applied by the housings (20, 50) as they are drawn together by the coupling ring (30). This anti-decoupling arrangement provides a first lower pressure against the spring (40) during the initial stage of the coupling cycle and a second higher pressure against the spring during the final stage of the coupling cycle thereby reducing the wear on the anti-decoupling mechanism an increasing its effectiveness.

5 Claims, 5 Drawing Figures

ANTI-DECOUPLING DEVICE FOR AN ELECTRICAL CONNECTOR

This invention relates to an electrical connector assembly of the type having a coupling ring for coupling and decoupling two housings of the connector assembly. The invention is more particularly related to an improved anti-decoupling mechanism that retains the coupled housings together against forces, such as vibration, which tend to uncouple the housings.

An electrical connector assembly is generally comprised of two separate housings connected together by a coupling ring mounted on one of the housings. The other housing and the coupling ring each have a thread which when mated together and the coupling ring is rotated draws the housings together and mates respective electrical contacts mounted within the housings. To prevent uncoupling of connector housings, some connector assemblies include springs, having a projection thereon, mounted inside the coupling ring that engage ratchet teeth projecting from one of the housings. In this approach the springs are continuously subjected to the same pressure range during the coupling and uncoupling of the connector housings. This results in excessive ratchet tooth wear after the housings have been coupled and uncoupled 500 times or more to comply with durability requirements. As the ratchet teeth wear the anti-decoupling mechanism becomes less effective, which increases the likelihood that the coupling ring will rotate thereby causing partial or complete decoupling and unmating of the electrical contacts within the connector housings. One example of an electrical connector assembly having this type of anti-decoupling mechanism may be found in U.S. Pat. No. 4,109,990 issued Aug. 29, 1978 and entitled "Electrical Connector Assembly Having Anti-Decoupling Mechanism". During coupling of such connector housings, the projection on each spring, within the coupling ring continuously engages ratchet teeth on the other housing within a constant pressure range and hence the teeth and projection are always subjected to the same wear during the entire coupling cycle, i.e., the complete threading of the coupling nut onto the threads of the other housing.

DISCLOSURE OF THE INVENTION

This invention reduces the wear between the engaging members of an anti-decoupling mechanism for an electrical connector assembly of the type utilizing a spring biased anti-decoupling mechanism between a coupling ring and one of the connector housings. The invention provides a first lower pressure against the spring during the initial stage of the coupling cycle and a second higher pressure against the spring during the final stage of the coupling cycle. The invention is characterized by an annular member that has a plurality of slots around the periphery thereof that engages the projection on each spring mounted within a coupling ring. The annular member is radially expandable to increase its diameter in response to opposing axially forces applied by the housings as they are drawn together by the coupling ring. The increased diameter of the annular member increases the pressure of the member against the spring during the final rotation of the coupling ring increasing the effectiveness of the anti-decoupling mechanism.

Accordingly, one advantage of this invention is that it provides reduced wear and increases the effectiveness of the anti-decoupling mechanism of an electrical connector.

Another advantage of this invention is that it eliminates the need for machining ratchet teeth into one of the housings of the connector assembly.

DETAILED DESCRIPTION OF THE INVENTION

Figure 1:
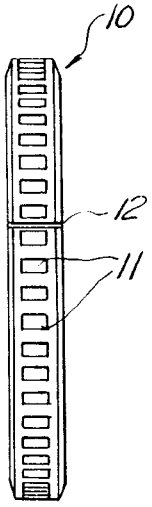

Referring now to the drawings, FIG. 1 illustrates an annular member 10 having a plurality of slots 11 around the periphery thereof. The slots 11 are adapted to receive the projection on each spring mounted within a coupling ring (41, FIG. 3). To allow the annular member 10 to be expanded and snapped onto a connector housing (20, FIG. 2) there is an opening 12 in the annular member 10. To prevent the annular member 10 from rotating once it is mounted on a housing a radially inwardly extending tab (not shown) extends from the annular member 10 into an appropriate slot in the housing. The annular member 10 is comprised of stainless steel and is stamped and formed from a piece of metal having a thickness of about 0.020 inches (0.050 centimeters).

Figure 2:
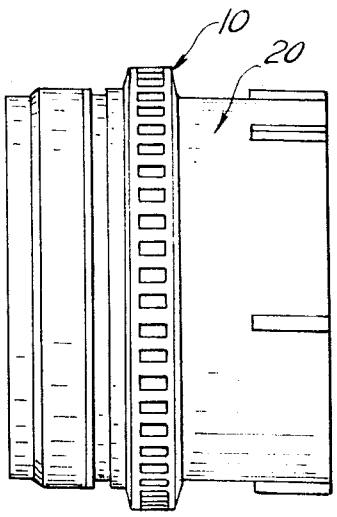

FIG. 2 illustrates the annular member 10 mounted to a connector housing 20. The annular member 10 may be mounted to the connector housing 20 by any suitable means that will prevent rotation of the annular member 10 relative to the connector housing 20.

Figure 3:
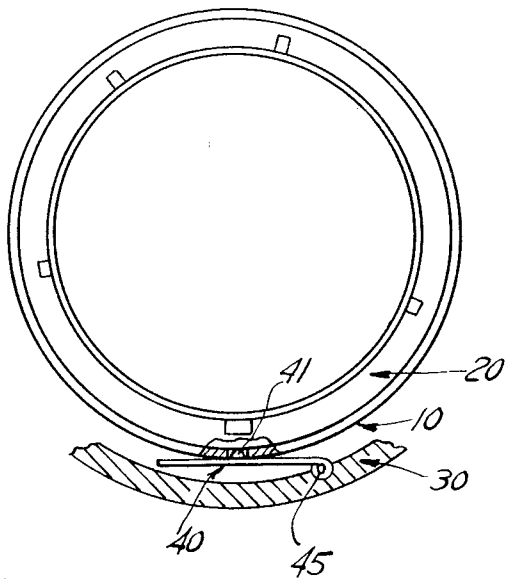
FIGS. 1, 2 and 3 illustrate a connector housing, a coupling ring and an anti-decoupling mechanism.

FIG. 3 is a partial view of an electrical connector assembly which illustrates a portion of a coupling ring 30 mounted to the housing 20. The coupling ring 30 preferably includes on the inside thereof four springs 40, each mounted at one end to the coupling ring 30 by a pin 45 inserted through a coiled end portion of the spring 40. Each spring 40 includes a radially inwardly extending projection 41 that engages a slot 11 in the annular member 10.

Figure 4:
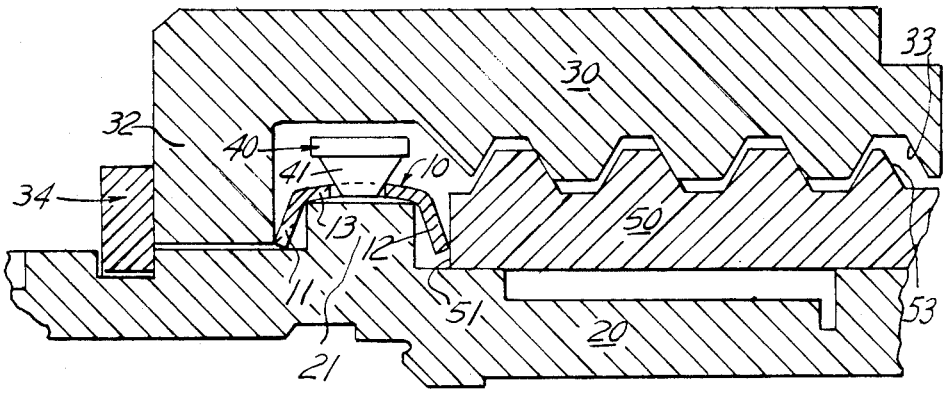
FIG. 4 is an enlarged diagramatic view of a portion of an anti-decoupling mechanism for an electrical connector assembly incorporating the principles of this invention.

FIG. 4 illustrates a partial diagrammatic view of an electrical connector assembly wherein the coupling cycle is almost completed. The coupling ring 30 is mounted to the first housing 20 by captivating the radial flange 32 of the coupling ring 30 between a snap ring 34 and an annular shoulder 21 on the housing 20. The inside of the coupling ring 30 includes a thread 33 which mates with a thread 53 on a second housing 50. As the coupling ring 30 is rotated, the free end 51 of the second housing is drawn towards the annular member 10 on the first housing 20. The annular member 10 is generally a C-shaped member having radial sides 11, 12 connected together by an axial side 13.

Figure 5:
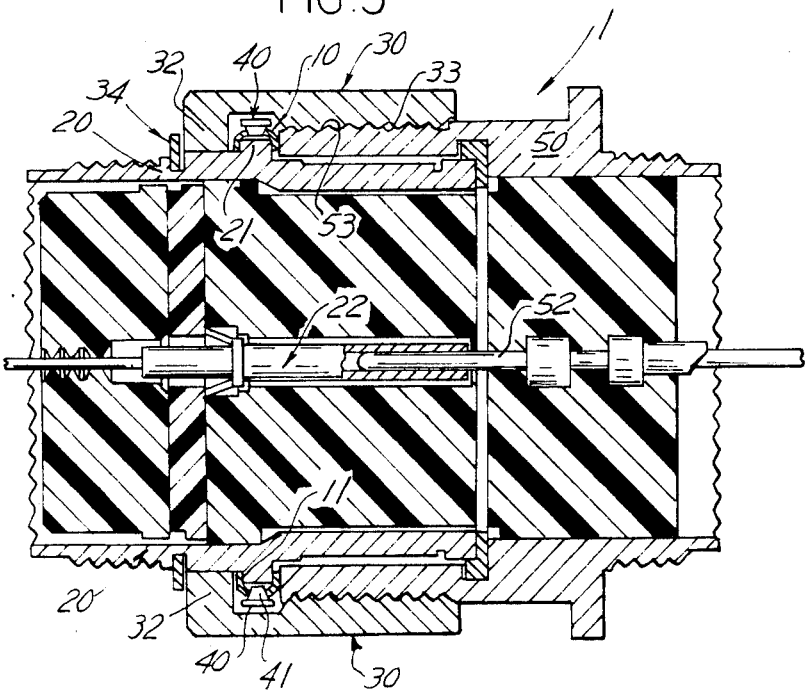
FIG. 5 illustrates a diagramatic view of an electrical connector assembly incorporating the principles of this invention.

FIG. 5 illustrates a diagrammatic view of an entire electrical connector assembly wherein the coupling cycle is completed. The first housing 20 includes one or more electrical contacts 22 mounted within the housing that are adapted to mate with one or more respective electrical contacts 52 mounted in the other connector housing 50. In the completed coupling cycle the contacts 22, 52 are fully mated and the forward end 51 of the housing 50 and the radial flange 32 of the coupling ring 30 have axially compressed the annular member 10 so that it has radially expanded to increase its outside diameter and applied increased pressure between the annular member 10 and the spring 40. This increases the pressure required to move each projection 41 from one slot 11 to another slot thereby increasing the anti-decoupling function of the mechanism.

Referring now to FIGS. 4 and 5, the anti-decoupling mechanism operates as follows: during the beginning and majority of the coupling cycle, i.e., when the threads 33 of the coupling ring 30 and the threads 53 of the housing 50 are initially mated and the coupling ring is rotated, the annular member 10 is in its normal position (FIG. 4) and the pressure between the annular member 10 and the spring 40 is in a first and lower range. However, in the final stage of the coupling cycle the free end 51 of the second housing 50 engages one side 12 of the annular member 10 and forces the other end 11 against the coupling ring flange 32, forcing member 10 to axially compress and radially expand. The pressure between the annular member 10 and spring 40 continues to increase, thereby requiring a higher coupling and uncoupling force during the final portion of the coupling cycle, until the radial side 12 of the annular member 10 can no longer be moved. The lower pressure between the members of the anti-decoupling mechanism during coupling and uncoupling significantly reduces the wear of these members and hence maintains the effectiveness of the anti-decoupling mechanism after repeated coupling cycles e.g. 500 times or more.

While a preferred embodiment of the invention has been disclosed, it will be apparent to those skilled in the art that minor changes may be made to the invention as set forth in the appended claims and, in some instances, certain features of the invention may be used to advantage without corresponding use of other features. For instance, the projection 41 may be located on the annular member 10 or housing 20 and the slots 11 may be located in the spring 40. Accordingly, it is intended that the illustrative and descriptive materials herein be used to illustrate the principles of the invention and not to limit the scope thereof.

Having described the invention, what is claimed is:

1. In combination with an electrical connector of the type having: a tubular housing; at least one electrical contact mounted in said housing; a coupling ring; means for rotatably mounting said coupling ring to said housing; at least one spring member having a projection; means for mounting one end of each spring member inside of said coupling ring so that said projection extends radially inwardly; and means for engaging the projection from said spring member to retard rotation of said coupling ring, the improvement wherein the means for engaging the projection from said spring member comprises:

an annular member having a plurality of slots around the periphery thereof, each slot being adapted to engage the projection on said spring member upon rotation of said coupling ring, said annular member being adapted to be radially expandable to increase its outside diameter in response to opposing axially applied forces; and means for mounting said annular member to said housing.

2. The electrical connector as recited in claim 1 wherein the annular member comprises:

a generally three sided member having two radial sides and an axial side.

3. The electrical connector as recited in claim 2 wherein the housing includes an annular shoulder and wherein the coupling ring is rotatably mounted adjacent to said shoulder with one radial side of said annular member located between a radial flange on said coupling ring and one side of said shoulder, the axial side of said annular member extending along the axial face of the shoulder with the other radial side of said annular member extending adjacent to the other side of said annular shoulder.

4. In combination with an electrical connector assembly of the type having: a first tubular housing; at least one electrical contact mounted in said first housing; a second tubular housing having a forward end and a thread on the outside of the forward portion of said housing; at least one electrical contact mounted in said second housing, each electrical contact mounted in said second housing mated with a respective contact mounted in said first housing; a coupling ring having a radial flange; means for rotatably mounting said coupling ring to said first housing, said coupling ring having a thread on the inside thereof mated to the thread on said second housing; and means for retarding the rotational movement of the coupling ring including: at least one spring mounted at one end to the inside of the coupling ring, each spring having a radially inwardly extending projection; and means mounted on said first housing for engaging the projection on said spring to retard movement of said coupling ring, the improvement wherein the means for engaging the projection on each spring mounted to the coupling ring comprises:

an axially compressible annular member which, upon axial compression, expands radially outwardly to increase the diameter of said annular member, said annular member located between the radial flange of said coupling ring and the forward end of said second housing, said annular member adapted to be compressed between the coupling ring flange and the forward end of said second housing when said coupling ring is rotated.

5. The electrical connector assembly as recited in claim 4 including an annular shoulder on said first housing, and wherein said annular member has a C-shaped cross section and is mounted around the annular shoulder on said first housing, said annular member having an axial side and first and second radial sides, said first radial side captivated between the flange of the coupling ring and one end of the annular shoulder on said first housing, said second radial side adapted to engage the forward end of said second housing upon axial movement of said second housing towards said annular shoulder to cause the annular member to expand radially outwardly to increase the radial pressure against each spring mounted to the coupling ring; the axial side of said annular member having a plurality of slots adapted to engage the projection on each spring.

* * * * *